United States Patent [19]

Matsushita et al.

[11] Patent Number: 4,520,783

[45] Date of Patent: Jun. 4, 1985

[54] METHOD OF CONTROLLING FUEL INJECTION AND APPARATUS THEREFOR

[75] Inventors: Souichi Matsushita; Kiyoshi Nakanishi, both of Susono; Tokuta Inoue, Mishima, all of Japan

[73] Assignee: Toyota Jidosha Kabushiki Kaisha, Toyota, Japan

[21] Appl. No.: 635,884

[22] Filed: Jul. 30, 1984

[30] Foreign Application Priority Data

Aug. 1, 1983 [JP] Japan ..... 58-140929

[51] Int. Cl.[3] ..... F02B 3/00

[52] U.S. Cl. ..... 123/492; 123/493; 123/494; 123/422

[58] Field of Search ..... 123/492, 493, 422, 494

[56] References Cited

U.S. PATENT DOCUMENTS 3,593,692 7/1971 Scholl ..... 123/492

3,720,191 3/1973 Rachel ..... 123/492

4,458,651 7/1984 Inoue ..... 123/492

*Primary Examiner*—Ronald B. Cox

*Attorney, Agent, or Firm*—Cushman, Darby & Cushman

[57] ABSTRACT

A fuel injection quantity is calculated on the basis of an engine speed and an engine load and is corrected by an output incremental value determined in accordance with acceleration and deceleration of an engine, at least. The position of an intake throttle valve is detected with regard to whether it is located within a small-opening region, an intermediate-opening region or a large-opening region. When the intake throttle valve is switched over from the small-opening region to the large-opening region, the output incremental value is increased to its maximum value. When the intake throttle valve is switched over from the small-opening region to the intermediate-opening region, the output incremental value is increased such as to gradually approach the maximum value. When the intake throttle valve is switched over from the large-opening region to the small-opening region, the output incremental value is decreased to almost zero. Further, when the intake throttle valve is switched over from the large-opening region to the intermediate-opening region, the output incremental value is gradually attenuated toward almost zero.

10 Claims, 13 Drawing Figures

| FIG.8A |
| --- |
| FIG.8B |

| No | CHANGE OF THROTTLE VALVE OPENING | $f_L$ | $f_R$ | C | $\Delta\tau$ |
|---|---|---|---|---|---|
| 1 | I → S → S | 1 | 0 | −K | DECREASE |
| 2 | L → S → S | 0 | 0 | — | REMAIN 0 |
| 3 | S → I | 0 | 1 | K | INCREASE |
| 4 | S → L | 0 | 0 | — | Ce |
| 5 | I → S | 1 | 0 | −K | DECREASE |
| 6 | S → I → I | 0 | 1 | K | INCREASE |
| 7 | L → I → I | 1 | 0 | −K | DECREASE |
| 8 | I → L | 0 | 1 | K | INCREASE |

| No | CHANGE OF THROTTLE VALVE OPENING | $f_L$ | $f_R$ | C | $\Delta\tau$ |
|---|---|---|---|---|---|
| 9 | L → S | 0 | 0 | — | 0 |
| 10 | L → I | 1 | 0 | −K | DECREASE |
| 11 | S → L → L | 0 | 0 | — | REMAIN Ce |
| 12 | I → L → L | 0 | 1 | K | INCREASE |

S : SMALL OPENING REGION

I : INTERMEDIATE OPENING REGION

L : LARGE OPENING REGION

FIG. 12

METHOD OF CONTROLLING FUEL INJECTION AND APPARATUS THEREFOR

BACKGROUND OF THE INVENTION

The present invention relates to a method of controlling a fuel injection and an apparatus therefor, and more particularly to a method of and an apparatus for controlling a fuel injection suitable for an engine of an automobile so as to optimize an air-fuel ratio for the engine during acceleration and deceleration of the automobile.

It is general practice in a fuel injection type internal combustion engine to calculate a fuel injection quantity on the basis of both intake-pipe absolute pressure and engine speed or both intake-air quantity and engine speed and to equally add a predetermined output incremental value to the calculated fuel injection quantity when a throttle valve of the engine has an opening amount more than its intermediate opening amount, e.g., 30° or more, thereby to obtain a necessary output.

When the above-mentioned output incremental value is excessively large, however, the output change becomes so large as to cause a shock. On the other hand, if the output incremental value is set to be relatively low in order to prevent such shock, it may not be possible to obtain excellent engine responsiveness during acceleration.

The above-described fuel injection type internal combustion engine includes such a type of engine that the air-fuel ratio for the engine is controlled to the leaner side for the purpose of reduction in fuel cost when the throttle valve has a small opening amount, e.g., 30° or less and after the engine has been completely warmed up. When an output air-fuel ratio, at which the maximum output torque is obtained, is obtained in such internal combustion engine by effecting the output incremental correction as described above, the air-fuel ratio quickly changes from a lean air-fuel ratio, e.g., 22 to the output air-fuel ratio, e.g., 12.5. Accordingly, when the throttle valve changes its open position from a small opening amount to an intermediate opening amount, a shock is caused which is unpleasant to the driver. It is to be noted that when the throttle valve changes its open position from a small opening amount to a large opening amount, the driver himself has the intention of sudden acceleration. Therefore, any shock resulting from the acceleration will not make the driver feel unpleasant.

SUMMARY OF THE INVENTION

Accordingly, it is a primary object of the invention to provide a method of and an apparatus for controlling a fuel injection which solve the above-described contradictory problems of the prior art and makes it possible to prevent any shock resulting from the output incremental correction while obtaining an excellent engine responsiveness during accleration.

To this end, according to the invention, there is provided a method of controlling a fuel injection wherein a fuel injection quantity is calculated on the basis of engine speed and engine load and is corrected by an output incremental value determined in accordance with acceleration and deceleration of an engine, at least, comprising the steps of: detecting the position of an intake throttle valve with regard to whether it is located within a small-opening region, an intermediate-opening region or a large-opening region; increasing the output incremental value to its maximum value when the intake throttle valve is switched over from the small-opening region to the large-opening region; increasing the output incremental value such that it gradually approaches the maximum value when the intake throttle valve is switched over from the small-opening region to the intermediate-opening region; decreasing the output incremental value to almost zero when the intake throttle valve is switched over from the large-opening region to the small-opening region; and gradually attenuating the output incremental value toward almost zero when the intake throttle valve is switched over from the large-opening region to the intermediate-opening region.

According to the invention, when the throttle valve is quickly changed from the small-opening region to the large-opening region, the output incremental value is maximized to obtain a new output air-fuel ratio. When the throttle valve is changed from the small-opening region to the intermediate-opening region, the output incremental value is increased such that it gradually approaches its maximum value. In contrast, when the throttle valve is quickly changed from the large-opening region to the small-opening region, the output incremental value is decreased to almost zero. Further, when the throttle valve is changed from the large-opening region to the intermediate-opening region, the output incremental value is attenuated such as to gradually approach almost zero. Therefore, it is possible to ease the unpleasant shock experienced by the driver which occurs when the throttle valve is switched over from the small-opening region to the intermediate-opening region or from the large-opening region to the intermediate-opening region. Moreover, it is possible to obtain an engine responsiveness during acceleration which is satisfactory to the driver.

The above and other objects, features and advantages of the invention will become clear from the following description of the preferred embodiment thereof, taken in conjunction with the accompanying drawings.

BRIEF DESCRIPTION OF THE DRAWINGS

FIG. 12 shows the output incremental value $\Delta\tau$ obtained by the routines of FIGS. 8 and 9.

DESCRIPTION OF THE PREFERRED EMBODIMENT

An embodiment of the invention will be described hereinunder in detail with reference to the accompanying drawings.

Figure 1:
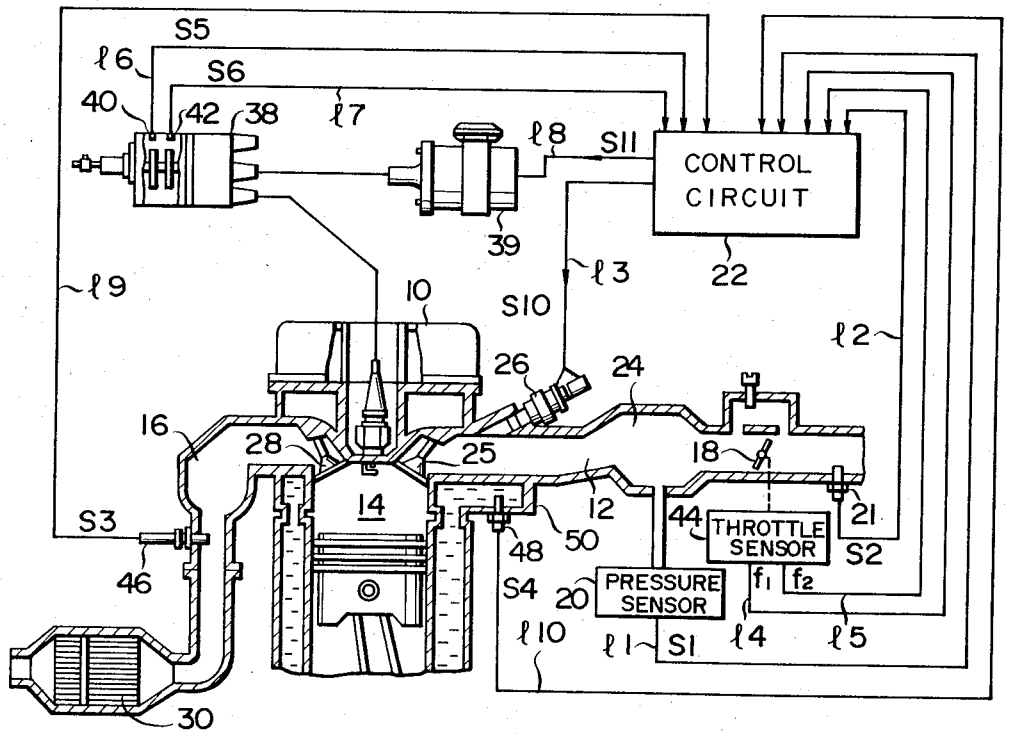
FIG. 1 is an illustration of the arrangement of an example of an internal combustion engine to which the invention is applied.

FIG. 1 shows an example of an electronically controlled fuel injection type internal combustion engine to which the invention is applied. In this Figure, the reference numeral 10 denotes an engine body, the numeral 12 an intake passage, the numeral 14 a combustion chamber, and the numeral 16 an exhaust passage. An intake-pipe absolute pressure sensor 20 is provided in the part of the intake passage 12 on the downstream side of a throttle valve 18. The pressure sensor 20 is connected to a control circuit 22 through a signal line $l_1$ and is adapted to generate a voltage corresponding to an intake-pipe absolute pressure. An intake-air temperature sensor 21 is provided in the part of the intake passage 12 which is on the upstream side of the throttle valve 18. The intake-air temperature sensor 21 is connected to the control circuit 22 through a signal line $l_2$ and is adapted to generate a voltage corresponding to an intake-air temperature. The intake air, which is introduced in through an air cleaner (not shown) and is controlled in flow rate by the throttle valve 18 which is interlocked with an acceleration pedal (not shown), is led to the combustion chamber 14 of each cylinder through a surge tank 24 and an intake valve 25.

A fuel injection valve 26 is provided for each cylinder and is arranged such that its opening/closing operation is controlled in accordance with electrical driving pulses supplied from the control circuit 22 through a signal line $l_3$. The fuel injection valve 26 injects a pressurized fuel supplied from a fuel supply system (not shown) into the part of the intake passage 12 in the vicinity of the intake valve 25, that is, an intake port portion. The exhaust gas resulting from the combustion of the fuel in the combustion chamber 14 is discharged into the atmospheric air through an exhaust valve 28, the exhaust passage 16 and an oxidation catalyst 30.

A distributor 38 of the engine is equipped with crank angle sensors 40 and 42, which are connected to the control circuit 22 through respective signal lines $l_6$, $l_7$. The sensor 40 delivers a pulse signal every 30° rotation of the crankshaft, while the sensor 42 delivers a pulse signal every 360° rotation of the crankshaft. These pulse signals are supplied to the control circuit 22 through respective signal lines $l_6$, $l_7$. The distributor 38 is connected to an ignitor 39, which is in turn connected to the control circuit 22 through a signal line $l_8$.

Figure 2:
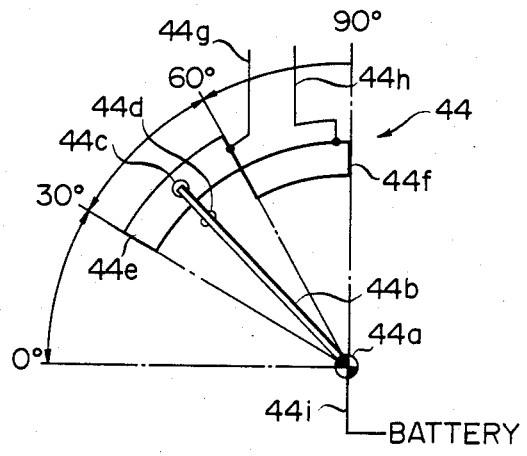
FIG. 2 is an illustration of an example of the throttle sensor of FIG. 1.

A throttle sensor 44 which detects the opening amount of the throttle valve 18 has, as shown in FIG. 2 in detail: a shaft 44*a* which rotates in either direction in one unit with the pivot of the throttle valve 18; a rotor 44*b* secured to the shaft 44*a*; a first contact 44*c* attached to the endmost portion of the rotor 44*b*; a second contact 44*d* attached to the portion of the rotor 44*b* closer to the center of rotation thereof; a first conductor plate 44*e* disposed within an intermediate-opening region of the throttle valve 18 ranging between rotor pivoting angles 30° and 60° and adapted to be able to contact the first contact 44*c* within that angle range; a second conductor plate 44*f* disposed within a large-opening region of the throttle valve 18 ranging between rotor pivoting angles 60° and 90° and adapted to be able to contact the second contact 44*d* within that angle range; a lead 44*g* connected to the first conductor plate 44*e*; a lead 44*h* connected to the second conductor plate 44*f*; and a lead 44*i* for applying a battery voltage to the side of the rotor 44*b* close to the center of rotation thereof. The leads 44*g*, 44*h* are connected to the control circuit 22 through respective signal lines $l_4$, $l_5$.

The throttle sensor 44 operates as follows: when the throttle valve 18 is within the small-opening region ranging from 0° to less than 30°, the output voltages delivered through the leads 44*g* and 44*h* are both zero; when the throttle valve 18 is within the intermediate-opening region ranging from 30° to less than 60°, the output voltage delivered through the lead 44*g* has a high level, while the output voltage delivered through the lead 44*h* is zero; and when the throttle valve 18 is within the large-opening region ranging from 60° to less than 90°, the output voltage delivered through the lead 44*g* is zero, while the output voltage delivered through the lead 44*h* has a high level. Thus, if the high level is represented by "1", the zero level by "0", the output signal delivered from the first conductor plate 44*e* through the lead 44*g* by f1, and the output signal from the second conductor plate 44*f* through the lead 44*h* by f2, then the pivoting angle of the throttle valve 18 may be expressed in accordance with the output signals f1, f2 as shown in Table 1 below.

TABLE 1

| Throttle valve opening region | Output signal f1 | Output signal f2 |
|---|---|---|
| Small | 0 | 0 |
| Intermediate | 1 | 0 |
| Large | 0 | 1 |

Referring back to FIG. 1, the exhaust passage 16 is provided therein with a lean sensor 46 which delivers a signal in response to the oxygen concentration contained in the exhaust gas, that is, generates an output voltage with a magnitude substantially proportional to an air-fuel ratio when it is leaner than a stoichiometric air-fuel ratio. The lean sensor 46 is connected to the control circuit 22 through a signal line $l_9$. The oxidation catalyst 30 is provided on the downstream side of the lean sensor 46 so as to purify HC and CO in the exhaust gas.

Further, the reference numeral 48 denotes a water temperature sensor adapted to detect the temperature of water for cooling the engine and to generate a voltage corresponding to the detected temperature. The water temperature sensor 48 is attached to a cylinder block 50 and is connected to the control circuit 22 through a signal line $l_{10}$.

Figure 3:
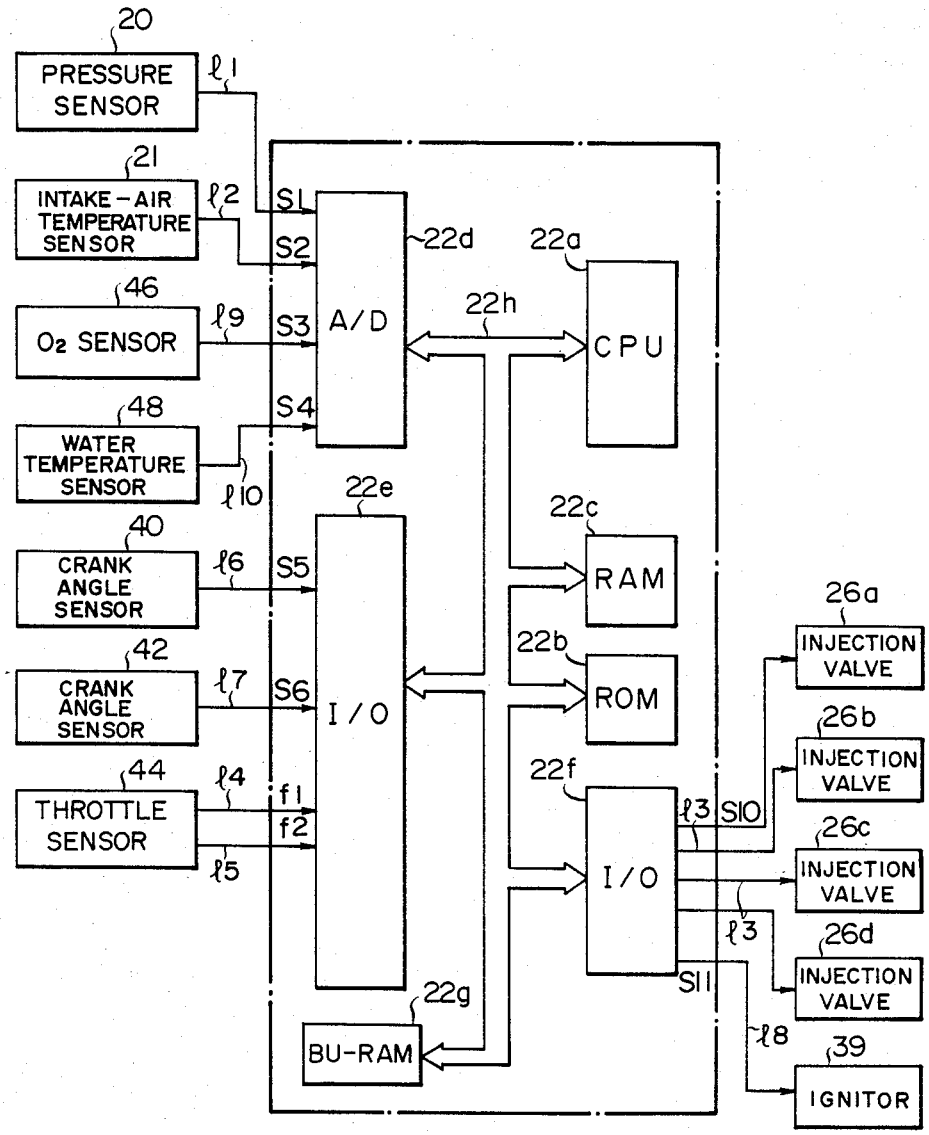
FIG. 3 is a detailed block diagram of an example of the control circuit of FIG. 1.

The control circuit 22 is, as shown in FIG. 3, composed of: a central processing unit (CPU) 22*a* which controls various devices; a read-only memory (ROM) 22*b* having various numerals and programs previously written thereinto; a random-access memory (RAM) 22*c* into which numerals and flags generated in the course of calculations are written and stored in their respective predetermined regions; an A/D converter (ADC) 22*d* which has an analog multiplexer function and converts an analog input signal into a digital signal; an input/output interface (I/O) 22*e* into which various digital signals are fed; an input/output interface (I/O) 22*f* from which various digital signals are delivered; a backup memory (BU-RAM) 22*g* which is supplied with power from an auxiliary power source at the time of suspension of the engine so as to hold stored data; and a bus line 22*h* connected with these devices.

The ROM 22b has previously stored therein a main routine program, an injection execution interrupt routine program, an ignition execution interrupt routine program, an output increment interrupt routine program, other sub-routine programs and various data required for various calculations.

The pressure sensor 20, the intake-air temperature sensor 21, the lean sensor 46 and the water temperature sensor 48 are connected to the A/D converter 22d, where voltage signals S1, S2, S3, S4 respectively delivered from the sensors are successively converted into respective binary signals according to instructions from the CPU 22a.

A pulse signal S5 delivered from the crank angle sensor 40 every crank angle of 30°, a pulse signal S6 delivered from the crank angle sensor 42 every crank angle of 360° and the output signals f1, f2 delivered from the throttle sensor 44 are fed to the control circuit 22 through the I/O 22e. On the basis of the pulse signal S5, a binary signal representing an engine speed is formed, while the pulse signals S5 and S6 cooperate with each other to form an interrupt request signal for calculating a fuel injection pulse width, a fuel injection start signal and a cylinder discriminating signal. According to the output signals f1, f2, the opening of the throttle valve 18 is determined as described above.

From the I/O 22f, a fuel injection pulse S10 and an ignition signal S11 formed by various calculations are respectively delivered to each of the fuel injection valves 26a to 26d and the ignitor 39 at predetermined timings.

In the internal combustion engine thus constructed, a basic fuel injection time duration TP representing a basic fuel injection quantity is calculated on the basis of both an intake-pipe pressure PM representative of engine loads and an engine speed NE, and the basic fuel injection time duration TP is corrected in accordance with various calculations to determine an injection time duration $\tau$.

For example, the injection time duration $\tau$ after correction is obtained by the following equation:

$$\tau = TP \times F + \Delta\tau \quad (1)$$

Figure 4:
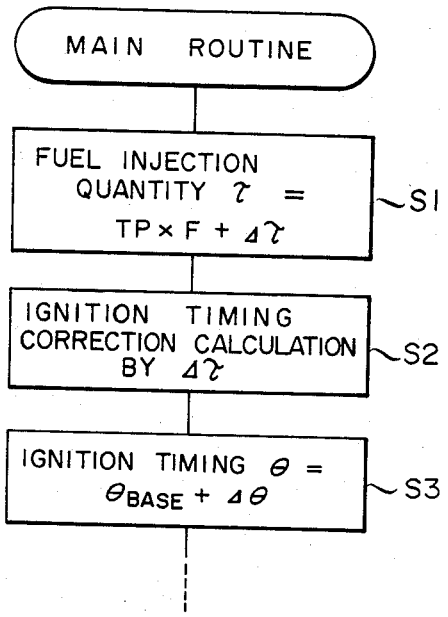
FIG. 4 is a flow chart showing an example of a main routine employed in the invention.

The calculation of the injection time duration $\tau$ is executed in a step S1 in the procedure for the main routine shown in FIG. 4. The symbol $\Delta\tau$ in the equation (1) represents an output incremental value, which is calculated through an output increment routine shown in FIG. 8 and an output increment sub-routine shown in FIG. 9.

Figure 5:
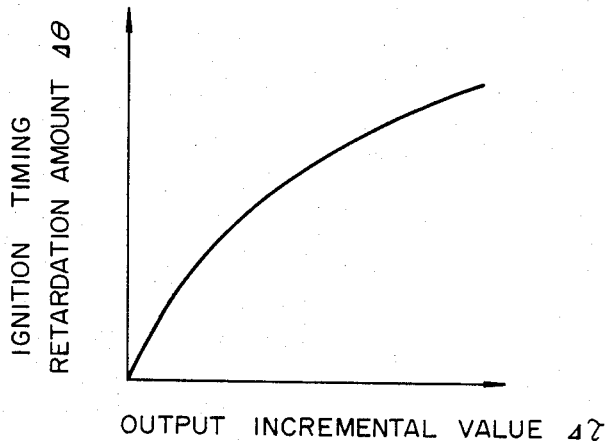
FIG. 5 is a graph showing the relationship between the output incremental value $\Delta\tau$ and the ignition timing retardation amount $\Delta\theta$.

It is to be noted that the symbol F in the equation (1) represents a correction coefficient employed for the increment in accordance with the water temperature and the like and the decrement by the lean control and the like. In this embodiment, when the throttle valve is at an open position within the small-opening region and after the engine has been completely warmed up, a lean feedback control is effected on the basis of the signal from the lean sensor 46, so that the air-fuel ratio is brought into a stoichiometric level. In addition to this control, when the throttle valve is at an open position out of the small-opening region, an open-loop control is effected, thereby to allow the air-fuel ratio to approach the output air-fuel ratio. In a step S2 in the main routine of FIG. 4, an ignition timing correction quantity $\Delta\theta$ in accordance with the output incremental value $\Delta\tau$ is calculated. In a step S3, the correction quantity $\Delta\theta$ is added to a basic ignition timing $\theta_{BASE}$ determined by both the intake-pipe pressure PM and the engine speed NE to calculate a final ignition timing $\theta$. In this case, the correction quantity $\Delta\theta$ can be obtained from a graph of FIG. 5 which shows the relationship between $\Delta\theta$ and $\Delta\tau$, and is predetermined such as to increase as the output incremental value $\Delta\tau$ increases.

Figure 6:
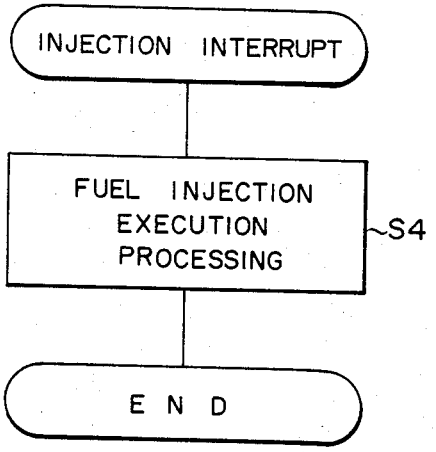
FIG. 6 is a program flow chart showing an example of an injection interrupt routine.
Figure 7:
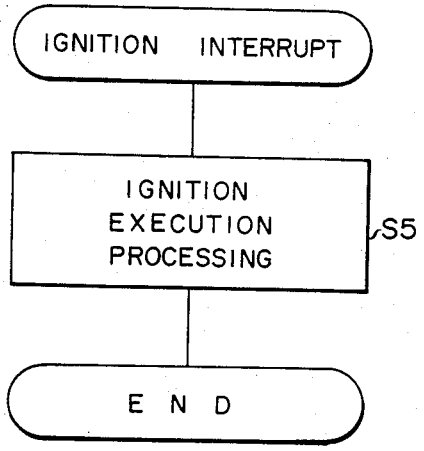
FIG. 7 is a program flow chart showing an example of an ignition interrupt routine.

It is to be noted that the fuel injection quantity or the fuel injection time duration $\tau$ thus obtained is formed as a signal S10 delivered to the injection valve. When an injection interrupt routine shown in FIG. 6 is started in accordance with a predetermined crank angle, the signal S10 is supplied to the injection valve 26 in a step S4 of the injection interrupt routine so as to open the injection valve 26 for a period of time represented by the signal S10. In an ignition interrupt routine shown in FIG. 7, on the other hand, in a step S5, the ignition signal S11 is supplied to the ignitor 39 at the timing which is coincident with the ignition timing $\theta$ to apply a high voltage to the ignition plug.

An example of a routine for calculating the output incremental value $\Delta\tau$ will be described hereinunder with reference to FIG. 8. This routine is executed at a predetermined interval counted by a timer, so the routine is so called a timer interrupt routine. When this routine is started, in a step S10, the present position of the throttle valve 18 is stored in predetermined memory regions M1, M2 on the basis of the signals f1, f2 from the throttle sensor 44. At this time, the data already stored in the regions M1, M2 are respectively shifted to other memory regions M11, M12 as signals f11, f12 representing the previous position of the throttle valve 18. In a step S20, the previous position of the throttle valve 18 is judged on the basis of the data stored in the memory regions M11, M12.

Figure 9:
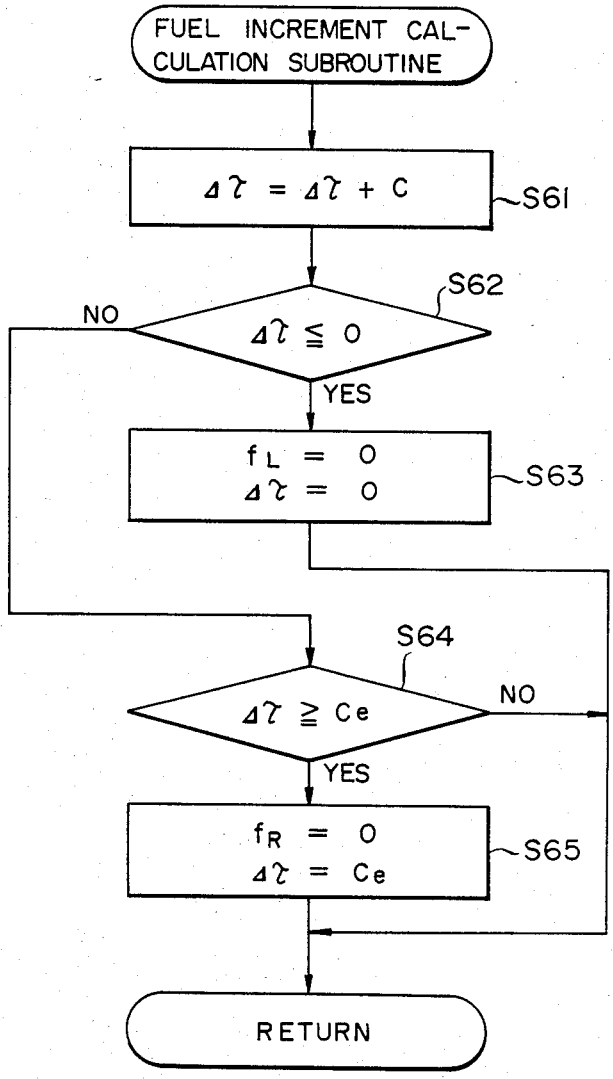
FIG. 9 is a program flow chart showing an example of an output incremental sub-routine.

(A) When the previous throttle valve position is within the small-opening region (f11=0, f12=0):

The process proceeds to a step 30 in which the signals f1, f2 representing the present throttle valve position are judged on the basis of the values of the memory regions M1, M2.

ⓐ When the present throttle valve position is within the small-opening region (f1=0, f2=0):

In a step S301, a flag $f_R$ is reset ("0"), and a judgement is made in a step S302 as to whether a flag $f_L$ is up ("1") or not. If No, the routine is ended without executing the output increment sub-routine shown in FIG. 9, described later. In this case, the fuel injection quantity $\tau$ is obtained from the output incremental value $\Delta\tau$ obtained in the previous calculation and stored in the memory region M3 alloted to the output incremental value $\Delta\tau$. If Yes, in a step S303, a correction data C to be added to the output incremental value $\Delta\tau$ in the output increment sub-routine of FIG. 9 is set to be a predetermined negative value $-K$, and the output increment sub-routine is executed in a step 312 to end this routine.

ⓑ When the present throttle valve position is within the intermediate-opening region (f1=1, f2=0):

In a step S311, the flag $f_L$ is reset ("0"), while the flag $f_R$ is set ("1"), and the correction data C is set to be a predetermined positive value K, and the sub-routine of FIG. 9 is executed in the step S312 to end this routine.

ⓒ When the present throttle valve position is within the large-opening region (f1=0, f2=1):

In a step S321, both the flags $f_L$ and $f_R$ are reset ("0"), and the output incremental value $\Delta\tau$ is set to be a maximum value Ce, and this routine is ended without executing the output increment sub-routine of FIG. 9.

(B) When the previous throttle valve position is within the intermediate-opening region (f11=1, f12=0):

The process proceeds to a step S40 in which the signals f1, f2 representing the present throttle valve position are judged on the basis of the values of the memory regions M1, M2.

ⓐ When the present throttle valve position is within the small-opening region (f1=0, f2=0):

In a step S401, the flag $f_L$ is set ("1"), and the flag $f_R$ is reset ("0"), and in a step S402, the correction data C is set to be a predetermined negative value −K. Further, the sub-routine of FIG. 9 is executed in a step S403 to end this routine.

ⓑ When the present throttle valve position is within the intermediate-opening region (f1=1, f2=0):

In a step S411, a judgement is made as to whether or not the flag $f_L$ is up ("1"). If Yes, the process proceeds through the step S402 to the step S403 in which the sub-routine of FIG. 9 is executed to end this routine. If No in the step S411, the process proceeds to a step 412 in which a judgement is made as to whether the flag $f_R$ is up ("1") or not. If Yes in a step S413, the correction data C is set to be a predetermined positive value K, and the process proceeds to the step S403 in which the sub-routine of FIG. 9 is executed to end this routine. If No in the step S412, the routine is ended without executing the sub-routine of FIG. 9. Also in this case, the fuel injection quantity $\tau$ is obtained from the output incremental value $\Delta\tau$ obtained by the previous calculation similarly to the above-described case.

ⓒ When the present throttle valve position is within the large-opening region (f1=0, f2=1):

In a step S414, the flag $f_L$ is reset ("0"), while the flag $f_R$ is set ("1"), and the correction data C is set to be a predetermined positive value K. The process proceeds to a step S415 in which the sub-routine of FIG. 9 is executed to end this routine.

(C) When the previous throttle valve position is within the large-opening region (f11=0, f12=1):

The process proceeds to a step S50 in which the signals f1, f2 representing the present throttle valve position are judged on the basis of the values of the memory regions M1, M2.

ⓐ When the present throttle valve position is within the small-opening region (f1=0, f2=0):

In a step S501, both the flags $f_L$ and $f_R$ are reset ("0"), and the output incremental value $\Delta\tau$ is made zero to end this routine.

ⓑ When the present throttle valve position is within the intermediate-opening region (f1=1, f2=0):

In a step S511, the flag $f_L$ is set ("1"), while the flag $f_R$ is reset ("0"), and the correction data C is set to be a predetermined negative value −K. The process proceeds to a step S512 in which the output increment sub-routine of FIG. 9 is executed to end this routine.

ⓒ When the present throttle valve position is within the large-opening region (f1=0, f2=1):

In a step S521, the flag $f_L$ is reset ("0"). Then the process proceeds to a step S522 in which a judgement is made as to whether the flag $f_R$ is up ("1") or not. If No, this routine is ended without executing the sub-routine of FIG. 9. Also in this case, the fuel injection quantity $\tau$ is obtained from the output incremental value $\Delta\tau$ obtained by the previous calculation similarly to the above-described cases. If Yes in the step S522, the correction data C is set to be a predetermined positive value K in a step S523. Then, and the sub-routine of FIG. 9 is ended in the step S512.

The following is a description of the sub-routine for the output increment calculation shown in FIG. 9.

Figures 8, 8A:
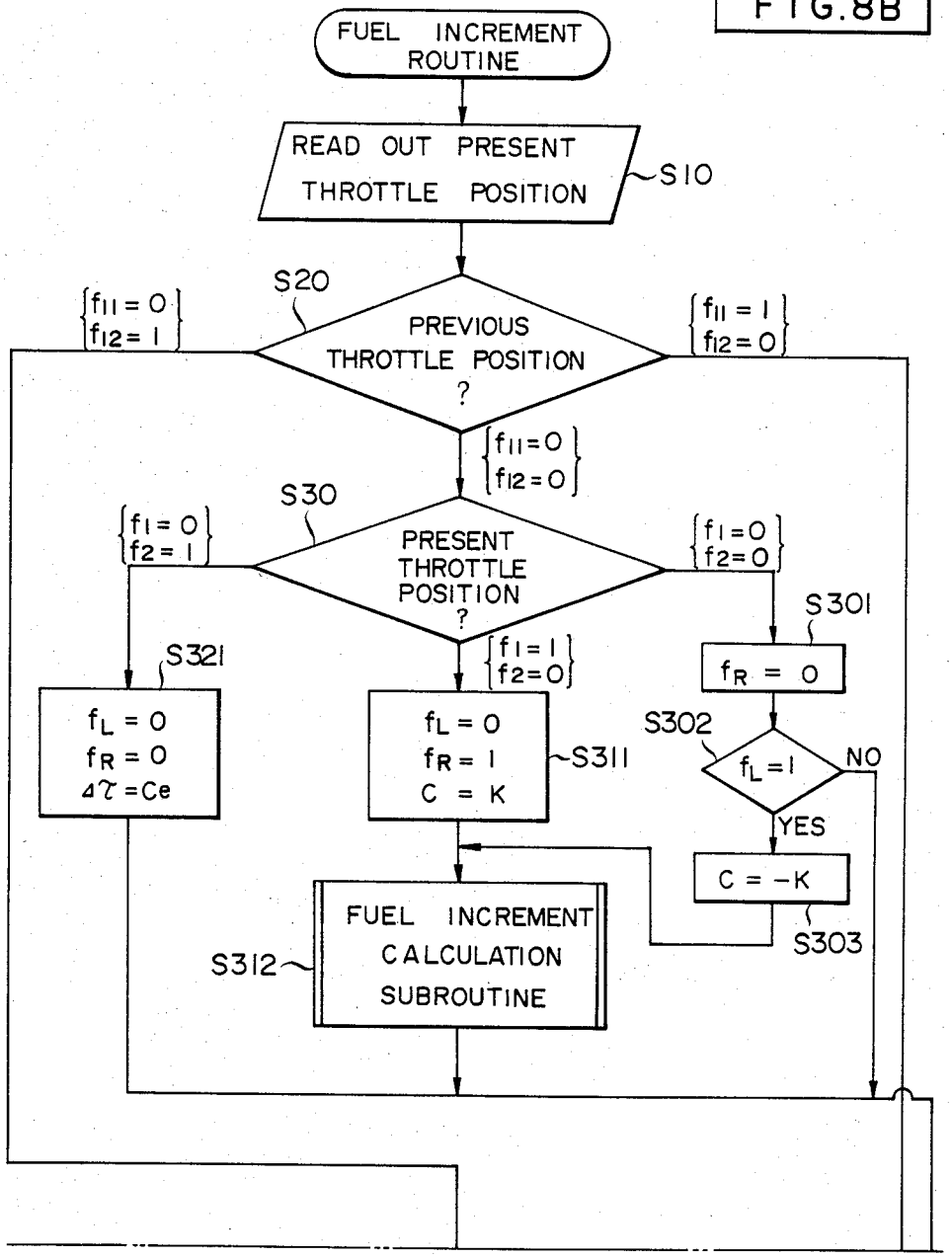
FIGS. 8A and 8B are a program flow chart showing an example of an output incremental routine.
Figure 8B:
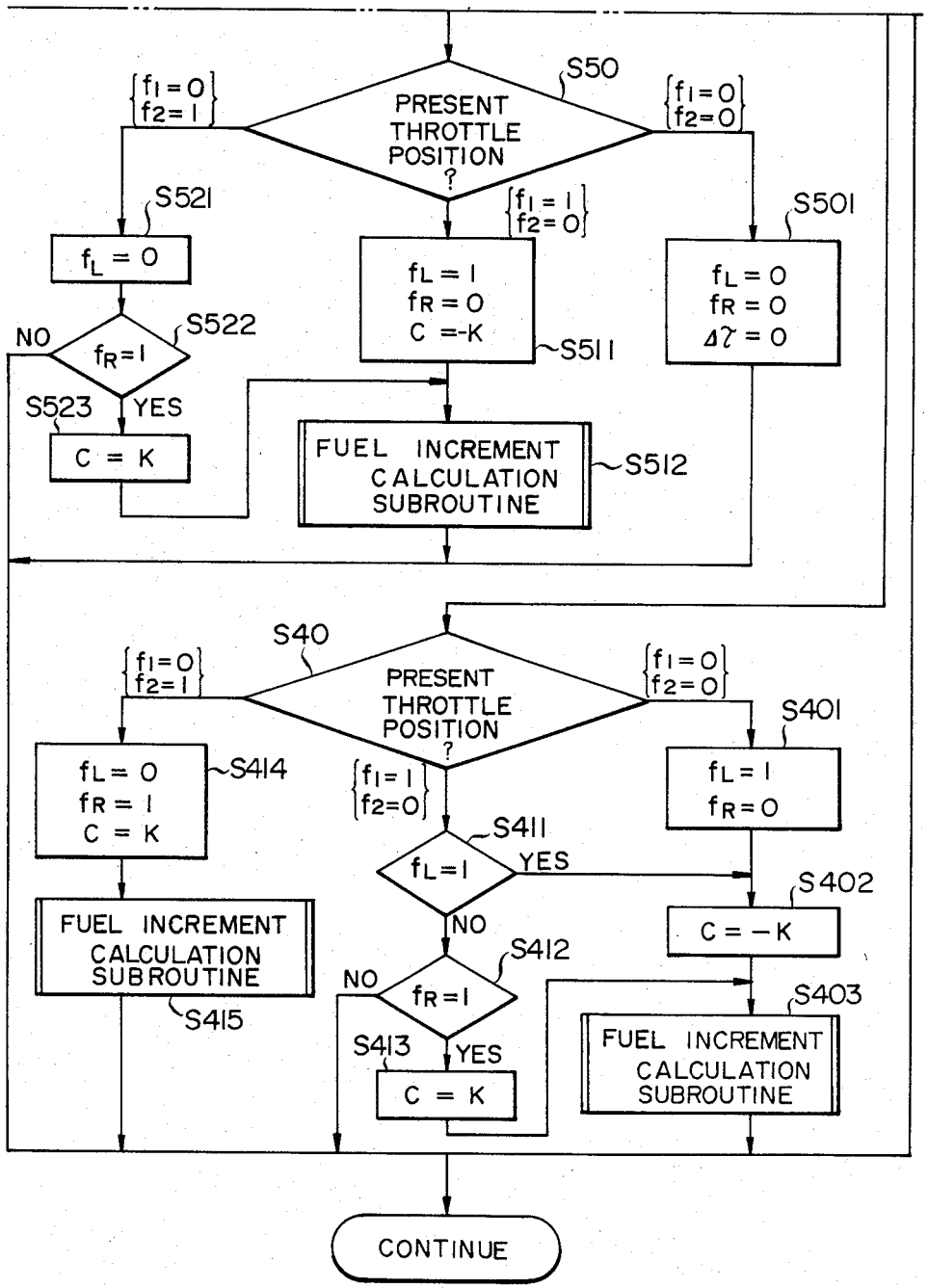

Upon start of this output increment sub-routine in response to the steps S312, S403, S415 or S512 of FIG. 8, in a step S61, the output incremental value $\Delta\tau$ read out from the memory region M3 is added to correction data C. The result of the addition is stored in the memory region M3 as a new output incremental value $\Delta\tau$. Then the process proceeds to a step S62 where a judgement is made as to whether or not the new output incremental value $\Delta\tau$ is zero or less. If the output incremental value $\Delta\tau$ is zero or less, in a step S63, the flag $f_L$ is reset ("0"), and the output incremental value $\Delta\tau$ is set to be zero to end this routine.

On the other hand, if a negative answer is judged in the step S62, the process proceeds to a step S64 in which a judgement is made as to whether the output incremental value $\Delta\tau$ is larger than the maximum value Ce or not. If the value $\Delta\tau$ is not larger than the maximum value Ce, this routine is ended. If the output incremental value $\Delta\tau$ exceeds the maximum value Ce, the process proceeds to a step S65 in which the flag $f_R$ is reset ("0"), and the output incremental value $\Delta\tau$ is set to be the maximum value Ce to end this routine.

Figure 10:
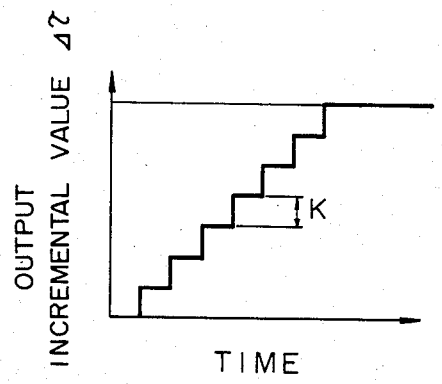
FIGS. 10 and 11 are graphs each showing the change of the output incremental value $\Delta\tau$ with time.
Figure 11:
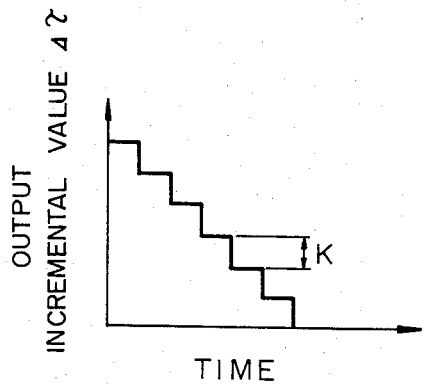

For example, in the case where the opening region of the throttle valve 18 changes from the small-opening region to the intermediate-opening region and the automobile continues running for a while in this state, the flag $f_R$ maintains its high ("1") state until the output incremental value $\Delta\tau$ exceeds the maximum value Ce. Therefore, every time the sub-routine of FIG. 9 is started, the output incremental value $\Delta\tau$ increases by +K as shown in FIG. 10. On the other hand, in the case, for example, where the opening region of the throttle valve 18 changes from the intermediate-opening region to the small-opening region and the automobile continues running for a while in this state, the flag $f_L$ maintains its high ("1") state until the output incremental value $\Delta\tau$ becomes zero. Therefore, every time the sub-routine of FIG. 9 is started, the output incremental value $\Delta\tau$ decreases by −K as shown in FIG. 11.

As has been described, in one embodiment of the invention, the output incremental value $\Delta\tau$ is controlled in accordance with the variation of the throttle valve 18 as shown in FIG. 12. In FIG. 12, a change in throttle opening region, as shown within the solid line rectangle causes the flags $f_L$ and $f_R$ to be equally set or rese. Therefore, the output incremental value $\Delta\tau$ is independent of the opening region of the throttle valve 18 detected by the detection carried out just before the previous detection. However, at the time of other throttle opening region changes, the output incremental value $\Delta\tau$ is affected by the flags $f_L$ and $f_R$ set in accordance with the throttle opening region change having occurred during the period from the detection effected just before the previous one to the previous detection or the throttle opening region change having occurred therebefore. Taking No. 6 and No. 7 shown in FIG. 12, for instance, where the engine operation within the intermediate-opening region continues for a while, the output incremental value $\Delta\tau$ is gradually increased or attenuated according to the flags set or reset in accordance with the throttle opening region change having occurred during the period from the detection carried out just before the previous one to the previous detection or the throttle opening region change having occurred therebefore. It is to be noted that in FIG. 12 each throttle opening region change shown within the broken line rectangle is the same as the corresponding throttle opening region change shown within the solid line rectangle.

As described above, in one embodiment of the invention, the output increment $\Delta\tau$ is properly determined in accordance with various changes in opening amount of the throttle valve 18. Therefore, it is possible to prevent any unpleasant shock under any operating conditions, and yet to improve the engine responsiveness during acceleration. Further, in this embodiment, throttle sensor 44 is employed which respectively delivers three different output signals for the small-opening region, the intermediate-opening region and the large-opening region of the throttle valve 18, and the three output signals are employed as they are to discriminate between the three regions of throttle opening. Accordingly, the need for any A/D converter is conveniently eliminated and the programs are favorably simplified as compared with the case where a potentiometer, for example, is employed to A/D convert a voltage corresponding to a pivoting angle of the throttle valve for the purpose of discriminating between the three regions.

Although in the above the invention has been described through one embodiment thereof in which the fuel injection quantity is calculated on the basis of the intake-pipe absolute pressure and the engine speed, the described embodiment is not exclusive and the fuel injection quantity may be calculated on the basis of the intake-air quantity measured by employing an air-flow meter and the engine speed.

Moreover, the invention has been described above by reference to an engine in which, when the intake throttle valve is at an open position within the small-opening region and after the engine has been completely warmed up, an overall lean feedback control is effected by using the lean sensor, while when the throttle valve is at an open position outside the small-opening region, that is, within the intermediate- or large-opening region, an open-loop control is effected, and a so-called stoichiometric air-fuel ratio control is not carried out. The invention is, however, not limited to use in such an engine. In other words, the invention is applicable to an engine adopting a so-called partial lean control in which, for example, the air-fuel ratio is controlled to the leaner side in the case where the throttle valve position is within the small-opening region, the engine has been completely warmed up and moreover the vehicle speed does not exceed a predetermined value, and when the throttle valve position is out of the small-opening region, that is, within the intermediate- or large-opening region, the air-fuel ratio is controlled by feedback so as to be in proximity of a stoichiometric air-fuel ratio. In such case, in place of the lean sensor, a so-called $O_2$ sensor may be employed. An output voltage of the $O_2$ sensor is stepwise changed in the vicinity of the stoichiometric air-fuel ratio, so that the air-fuel ratio is detected by the $O_2$ sensor. In addition, in place of the oxidation catalyst, a three-way catalyst is employed which simultaneously purifies HC, CO and $NO_x$.

Furthermore, the invention is also applicable to an engine in which neither overall lean control nor partial lean control is carried out but the output increment of fuel is effected when the throttle valve has an opening amount larger than that in the intermediate-opening region.

What is claimed is:

1. A method of controlling a fuel injection wherein a basic fuel injection quantity is calculated on the basis of an engine speed and an engine load and is corrected at least by an output incremental value determined in accordance with acceleration or deceleration of an engine thereby to determine a final fuel injection quantity, at least, comprising the steps of:

detecting a position of a throttle valve with regard to whether it is located within one of a small-opening region, an intermediate-opening region and a large-opening region;

correcting said basic fuel injection quantity in accordance with said output incremental value determined in such a manner that it becomes its maximum value when said throttle valve is switched over from said small-opening region to said large-opening region thereby to abruptly increase said basic fuel injection quantity, that it gradually approaches said maximum value when said throttle valve is switched over from said small-opening region to said intermediate-opening region thereby to gradually increase said basic fuel injection quantity, that it becomes substantially zero when said throttle valve is switched over form said large-opening region to said small-opening region thereby to terminate the increase of said basic fuel injection quantity, and that it is gradually attenuated toward substantially zero when said throttle valve is switched over from said large-opening region to said intermediate-opening region thereby to gradually decrease said basic fuel injection quantity.

2. A method according to claim 1, wherein said basic fuel injection quantity is corrected by the following formula;

$$\tau = TP + \Delta\tau$$

where $\tau$: corrected fuel injection quantity

TP: basic fuel injection quantity $\Delta\tau$: output incremental value.

3. A method according to claim 1, wherein in said small-opening region, said final basic fuel injection quantity is adapted to be determined so that an air-fuel ratio is brought into a leaner side of the stoichiometric air-fuel ratio and in said intermediate-opening and large-opening regions, said final basic fuel injection quantity is adapted to be determined so that an air-fuel ratio is brought into the air-fuel ratio being equal to the stoichiometric air-fuel ratio or less.

4. A method according to claim 3, wherein said basic fuel injection quantity is corrected by the following formula;

$$\tau = TP \times F + \Delta\tau$$

where $\tau$: corrected fuel injection quantity

TP: basic fuel injection quantity $\Delta\tau$: output incremental value

F: correction coefficient said correction coefficient being determined such that when the throttle valve is in the small-opening region the air-fuel ratio becomes the leaner side of the stoichiometric air-fuel ratio and said correction coefficient being "1" when the throttle valve is in the intermediate-opening and large-opening regions.

5. A method according to claim 1 further comprising the steps of:

correcting, in accordance with the output incremental value, a basic ignition timing such that it is retarded as the output incremental value becomes larger.

6. An apparatus for controlling a fuel injection for an internal combustion engine provided with a throttle valve in an intake passage, said apparatus comprising:

means for determining a basic fuel injection quantity in accordance with an engine speed and an engine load;

means for detecting a position of the throttle valve with regard to whether it is located within one of a small-opening region, an intermediate-opening region and a large-opening region;

means for correcting said basic fuel injection quantity at least by an output incremental value when acceleration or deceleration of the engine is detected by said detecting means; and means for determining said output incremental value in accordance with change in a throttle valve opening region such that when said throttle valve is switched over from said small-opening region to said large-opening region, said output incremental valve becomes its maximum value thereby to abruptly increase said basic fuel quantity;

when switched from said small-opening region to said intermediate-opening region, said output incremental value gradually approaches said maximum value thereby to gradually increase said basic fuel injection quantity;

when switched from said large-opening region to said small-opening region, said output incremental value becomes substantially zero thereby to terminate the increase of said basic fuel injection quantity; and when switched from said large-opening region to said intermediate-opening region, said output incremental valve attenuates toward substantially zero thereby to gradually decrease said basic fuel injection quantity.

7. An apparatus according to claim 6, wherein said correcting means corrects said basic fuel injection quantity by the following formula;

$$\tau = TP + \Delta\tau$$

where $\tau$: corrected fuel injection quantity

TP: basic fuel injection quantity $\Delta\tau$: output incremental value.

8. An apparatus according to claim 6, wherein said correcting means corrects said basic fuel injection quantity in such a manner that in said small-opening region, said basic fuel injection quantity is adapted to be corrected so that an air-fuel ratio is brought into a leaner side of the stoichiometric air-fuel ratio and in said intermediate-opening and large-opening regions, said basic fuel injection quantity is adapted to be corrected so that the air-fuel ratio is equal to the stoichiometric air-fuel ratio or less.

9. An apparatus according to claim 8, wherein said correcting means corrects said basic fuel injection quantity by the following formula;

$$\tau = TP \times F + \Delta\tau$$

where $\tau$: corrected fuel injection quantity

TP: basic fuel injection quantity $\Delta\tau$: output incremental value

F: correction coefficient said correction coefficient being determined such that when the throttle valve is in the small-opening region the air-fuel ratio becomes the leaner side of the stoichiometric air-fuel ratio and said correction coefficient being "1" when the throttle valve is in the intermediate-opening and large-opening regions.

10. An apparatus according to claim 6 further comprising:

means for correcting, in accordance with the output incremental value, a basic ignition timing such that it is retarded as the output incremental value becomes larger.

* * * * *